US005458427A

United States Patent [19]

Simond

[11] Patent Number: 5,458,427

[45] Date of Patent: Oct. 17, 1995

[54] TELESCOPIC TUBULAR SPLINED ASSEMBLY

[76] Inventor: Ludger Simond, Les Bossons, 74400 Chamonix Mont Blanc, France

[21] Appl. No.: 137,150

[22] PCT Filed: Apr. 14, 1992

[86] PCT No.: PCT/FR92/00328

§ 371 Date: Jan. 24, 1994

§ 102(e) Date: Jan. 24, 1994

[87] PCT Pub. No.: WO92/20413

PCT Pub. Date: Nov. 26, 1992

[30] Foreign Application Priority Data

May 24, 1991 [FR] France ..... 91 06359

[51] Int. Cl.[6] ..... A63C 11/22; F16B 7/14

[52] U.S. Cl. ..... 403/109; 403/203; 403/110; 403/314; 403/370; 403/383; 280/820; 280/822; 280/823

[58] Field of Search ..... 403/109, 203, 403/314, 370, 383, 110, 359; 280/819, 820, 822, 823

[56] References Cited

U.S. PATENT DOCUMENTS

| | | | |
|---|---|---|---|
| 1,665,811 | 4/1928 | Hadden | 280/823 X |
| 2,275,330 | 3/1942 | Tveten | 280/823 |
| 2,456,205 | 12/1948 | Magder . | |
| 2,512,985 | 6/1950 | Tveten | 280/823 |
| 2,526,415 | 10/1950 | Refsdal | 280/823 X |
| 2,533,733 | 12/1950 | Jensen | 280/823 X |
| 4,238,164 | 12/1980 | Mazzolla | 403/109 |
| 4,441,837 | 4/1984 | Mastroni | 403/314 X |

FOREIGN PATENT DOCUMENTS

| | | | |
|---|---|---|---|
| 0217556 | 4/1987 | European Pat. Off. . | |
| 0314357 | 5/1989 | European Pat. Off. . | |
| 929616 | 1/1948 | France . | |
| 2417314 | 9/1979 | France . | |
| 2475911 | 8/1981 | France | 280/823 |
| 1058889 | 6/1959 | Germany . | |
| 2402428 | 8/1974 | Germany | 280/823 |
| 2407464 | 8/1975 | Germany . | |
| 72425 | 8/1947 | Norway | 280/823 |
| 267177 | 6/1950 | Switzerland . | |

*Primary Examiner*—Randolph A. Reese
*Assistant Examiner*—Christopher J. Novosad
*Attorney, Agent, or Firm*—William H. Eilberg

[57] ABSTRACT

The present invention concerns telescopic tubular assemblies comprising a plurality of successive tubular sections sliding one inside the other between a retracted position and a deployed position. One non-limiting example of such assemblies is a ski stick.

13 Claims, 7 Drawing Sheets

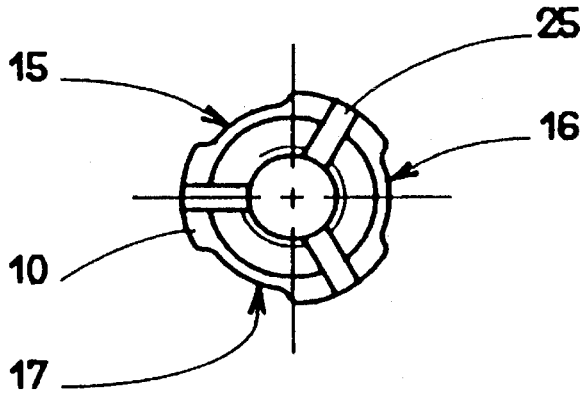
Flg. 3
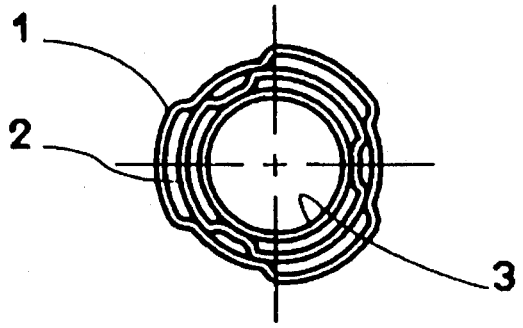
Flg. 4
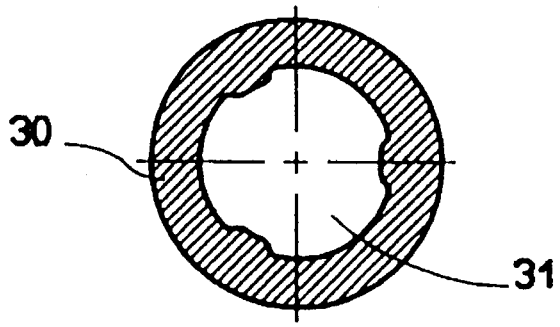
Flg. 5

TELESCOPIC TUBULAR SPLINED ASSEMBLY

The present invention concerns telescopic tubular assemblies comprising a plurality of successive tubular sections sliding one inside the other between a retracted position and a deployed position. One non-limiting example of such assemblies is a ski stick.

These telescopic sticks enable the length of the stick to be adjusted to suit the slope over which the user is travelling.

The stick is designed to withstand axial loads. Consequently, selective locking means must be provided to immobilize the sections against axial relative movement in a deployed position, a retracted position or any intermediate position.

Various structures have already been proposed for locking the sections one within the other. In most of these structures an axial end piece is fixed to and extends a smaller diameter first tubular section. The end piece usually comprises a conical bearing surface and a screwthreaded part. An expandable locking collar slides axially on the larger diameter tubular section and comprises a usually conical interior bearing surface which bears against the conical bearing surface of the axial end piece. Actuator means such as a nut slide axially in the larger diameter tubular section and can be locked against rotation in this tubular section, the actuator means screwing onto the screwthreaded part of the axial end piece in order to clamp and unclamp the collar in the axial direction by relative rotation of the tubular sections.

In the document FR-A-929 616, for example, the actuator means comprise the locking collar itself which rubs against the inside wall of the larger diameter tube. Locking of the collar against rotation is somewhat hit and miss.

In the document DE-A-2 407 464 the actuator means also comprise the collar itself which is locked against rotation in the larger diameter tube by a longitudinal rib projecting from the inside surface of the tube and accommodated in a longitudinal groove on the collar. In this design the interior rib on the larger diameter tube is an impediment to guided sliding of the smaller diameter tube inside the larger diameter tube. The two tubes are not concentric and the guiding action between them is inadequate. When bending loads are applied to the stick the interior rib deforms the smaller diameter tube which causes it to deteriorate.

In the document DE-B-1 058 889 the actuator means also comprise the locking collar itself which is able to slide in the larger diameter tube and is locked against rotation in this tube by two diametrally opposite ribs in the collar which engage in two grooves in the inside surface of the larger diameter tube. Exterior ribs project from the exterior surface of the larger diameter tube, in corresponding relationship to the interior grooves. This design may be suitable for a stick comprising only two sections. However, the exterior ribs on the larger diameter tube prevent the fitting and correct retention of a third tube over the larger diameter tube.

The problem to which the present invention is addressed is to design a new locking structure which achieves good guidance of the tubes relative to each other without imposing excessive mechanical loads on the locking collar and in a way that is compatible with the use of three or more successive tubes.

As sticks of this kind are sometimes used under severe conditions it is important that the locking and unlocking of the sections one within the other is particularly reliable: there must be no unintentional sliding of the sections one within the other and no unintentional binding.

To achieve these and other objects a telescopic tubular assembly in accordance with the invention comprises:

at least one larger diameter first tubular section and one smaller diameter second tubular section having an inside end housed inside the first tubular section and able to rotate freely and to slide inside the first tubular section between a retracted position and a deployed position, an actuator device comprising a first actuator member sliding in the larger diameter first tubular section and comprising a second actuator member fixed to the smaller diameter second tubular section, the first actuator member and the second actuator member cooperating with each other in the manner of a screw in order to displace the first actuator member axially upon relative axial rotation, an expandable locking member sliding axially in the larger diameter first tubular section, constrained to move in axial translation with the smaller diameter second tubular section and acted on by the first actuator member of the actuator device selectively to expand it radially or to retract it when it moves axially, rotation locking means for immobilizing the first actuator member against rotation in the larger diameter first tubular section, in accordance with the invention:

the interior surface of the larger diameter first tubular section comprises at least three equi-angularly distributed longitudinal ribs each engaged in a respective longitudinal peripheral locking groove of the first actuator member to lock it against rotation, said ribs extend along all or the major part of the length of the first tubular section, the ribs are shaped to bear with a small clearance and simultaneously against the exterior surface of the smaller diameter second tubular section, said ribs have a wide and rounded outermost surface to mate with a significant portion of the exterior surface of the second tubular section and to constitute between the tubular sections a bearing surface adapted to withstand mechanical bending loads exerted on the telescopic tubular assembly.

In this design the interior ribs of the larger diameter tube form splines which lock the first actuator member against rotation and guide and retain the smaller diameter tube when it slides inside the larger diameter tube.

The interior ribs of the tubular sections are advantageously formed by depressing the tubular section wall to form simultaneously exterior longitudinal grooves which are narrower than the interior ribs. The resulting tubular splined structure is particularly rigid and this is achieved without any increase in weight.

This design is compatible with the use of more than two successive sections by ensuring that the exterior grooves of the smaller diameter tube are narrower than the interior ribs of the larger diameter tube in a junction area to prevent their mutual interengagement.

This design is also compatible with various embodiments of the actuator member and the expandable member as described and claimed hereinafter.

Other objects, features and advantages of the present invention will emerge from the following description of one specific embodiment of the invention given with reference to the accompanying drawings in which:

FIG. 1 is a side elevational view, partially shown in cross-section of the locking area between two successive sections of a telescopic stick in one embodiment of the present invention;

FIG. 1*a* is an end view of the first tubular section 1;

FIG. 1*b* is an end view of the second tubular section 2;

FIG. 3 is an end view of the locking collar as seen in the direction of the arrow A in FIG. 1;

FIG. 4 shows the sliding of respective sections one within the other in transverse cross-section;

FIG. 5 is a view in cross-section on the line B—B in FIG. 1;

Figure 1:
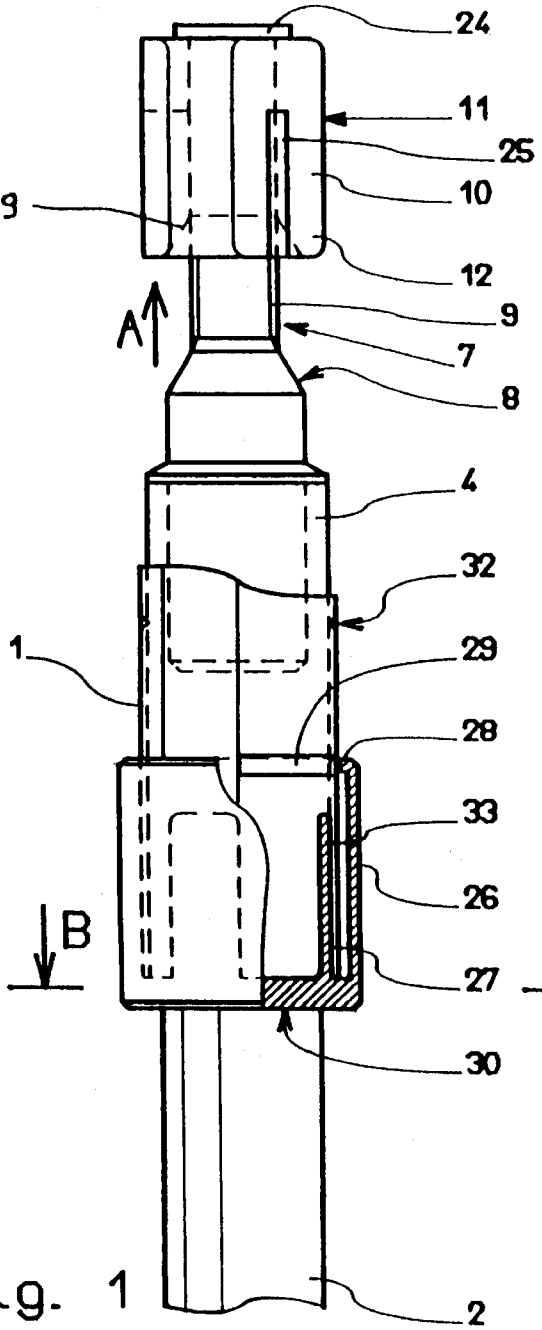

In the embodiment shown in the figures the telescopic tubular assembly in accordance with the present invention is a stick with three successive sections, namely a larger diameter first tubular section 1, a smaller diameter second tubular section 2 and an even smaller diameter third tubular section 3. The second section 2 slides inside the first section 1. The third section 3 slides inside the second section 2. Part of the second section 2 remains at all times inside the first section 1 and has an inner end 4.

The largest diameter first tubular section 1 has a cylindrical interior surface 5 of generally circular cross-section comprising at least three low longitudinal ribs 6, 13 and 14 along all or the major part of its length.

The smaller diameter second tubular section 2 has a cylindrical exterior surface 60 of generally circular cross-section shaped to slide axially in the interior space delimited by the interior surface 5 and the longitudinal ribs 6, 13 and 14 of the larger diameter first tubular section 1.

In the advantageous embodiment shown in the figures the interior surface 5 of the first tubular section 1 has three equi-angularly spaced longitudinal ribs 6, 13 and 14. The three longitudinal ribs 6, 13 and 14 engage in respective grooves 15, 16 and 17 on the locking collar 10. The ribs 6, 13 and 14 are preferably formed by depressing the wall of the tube forming the first tubular section 1 so that the exterior longitudinal grooves 18, 19 and 20 are formed at the same time. The exterior longitudinal grooves 18, 19 and 20 are slightly narrower than the respective interior ribs 6, 13 and 14.

The ribs 6, 13 and 14 have to define the bearing surface against which the interior tubular section 2 slides or turns. This bearing surface must be capable of withstanding mechanical bending loads to be applied between two successive sections of a telescopic stick. To this end, and as shown in the figures, the ribs 6, 13 and 14 have a wide and rounded outermost surface to mate with a significant part of the exterior surface of the second tubular section. The ribs 6, 13 and 14 are shaped to bear simultaneously and with a small clearance against the outside surface of the second tubular section 2.

The second tubular section 2 comprises ribs and grooves similar to those of the first tubular section. However, to allow free rotation of the second tubular section 2 in the first tubular section 1 its exterior grooves 21, 22 and 23 are narrower than the interior ribs 6, 13 and 14 of the first tubular section 1. Accordingly, the interior ribs 6, 13 and 14 of the first tubular section cannot engage in the respective exterior grooves 21, 22 and 23 of the second tubular section which is therefore free to pivot axially in the first tubular section 1.

In the embodiment of FIGS. 1 through 10 the second tubular section 2 is extended at its inner end 4 by an axial end piece 7 comprising a generally conical bearing surface 8 extended for example by a smaller diameter screwthreaded part 9. A screwthreaded locking collar 10 is screwed onto the screwthreaded part 9 of the axial end piece 7 and has a generally cylindrical exterior surface 11 shaped to slide axially with a small clearance in the first tubular section 1 and to be locked against rotation by the interior ribs 6, 13 and 14 of the first tubular section 1. The locking collar 10 has an end area 12 which is elastically deformable in the radial direction and oriented axially to bear against the conical surface 8.

The locking collar 10 comprises a central screwthreaded bore 37 to cooperate with the screwthread on the screwthreaded part 9 and a first generally conical bearing surface 39 to cooperate with the conical bearing surface 8. The collar 10 is screwed onto the screwthreaded part 9. The length of the locking collar 10 is slightly less than the length of the screwthreaded part 9. The free end 24 of the screwthreaded part 9 has a wider part whose diameter is greater than the inside diameter of the locking collar 10 to form an abutment limiting the travel of the collar away from the conical bearing surface 8.

The end area 12 of the locking collar 10 comprises longitudinal slots such as slot 25 to increase its flexibility. This enables radial deformation of the end area 12 by the action of the conical bearing surface 8 at the end of screwing the locking collar 10 onto the screwthreaded part 9.

In this embodiment the collar 10 constitutes the expandable member and the first actuator member and the end piece constitutes the second actuator member.

Figure 2:
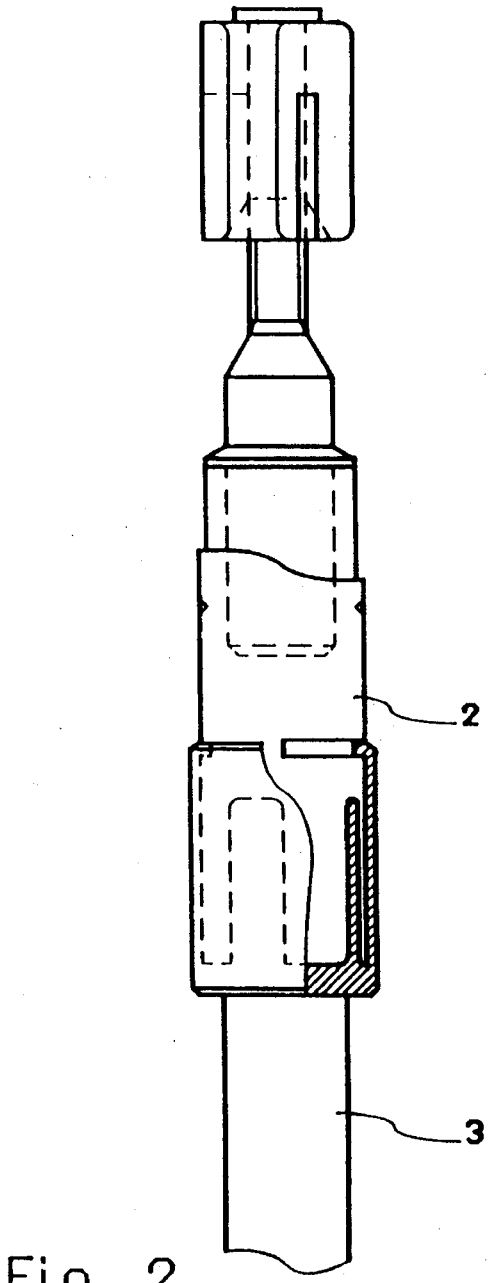
FIG. 2 is a view similar to that of FIG. 1, showing a second locking area of a stick in accordance with the present invention.
Figure 1A:
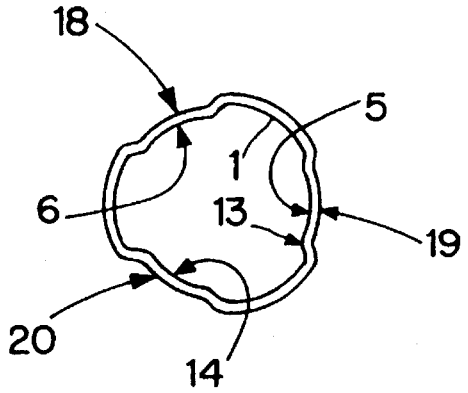
Figure 1B:
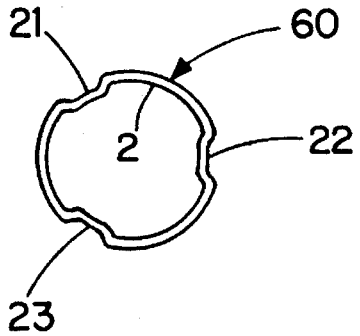
Figure 2A:
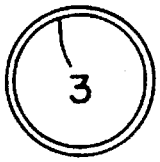
Figure 6:
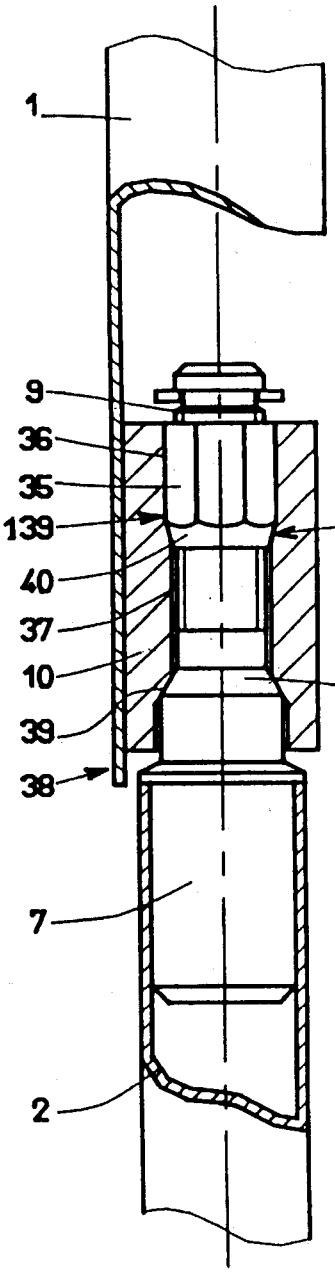
FIG. 6 is a view in partial cross-section of the locking area between two successive sections in another embodiment of the present invention.
Figure 7:
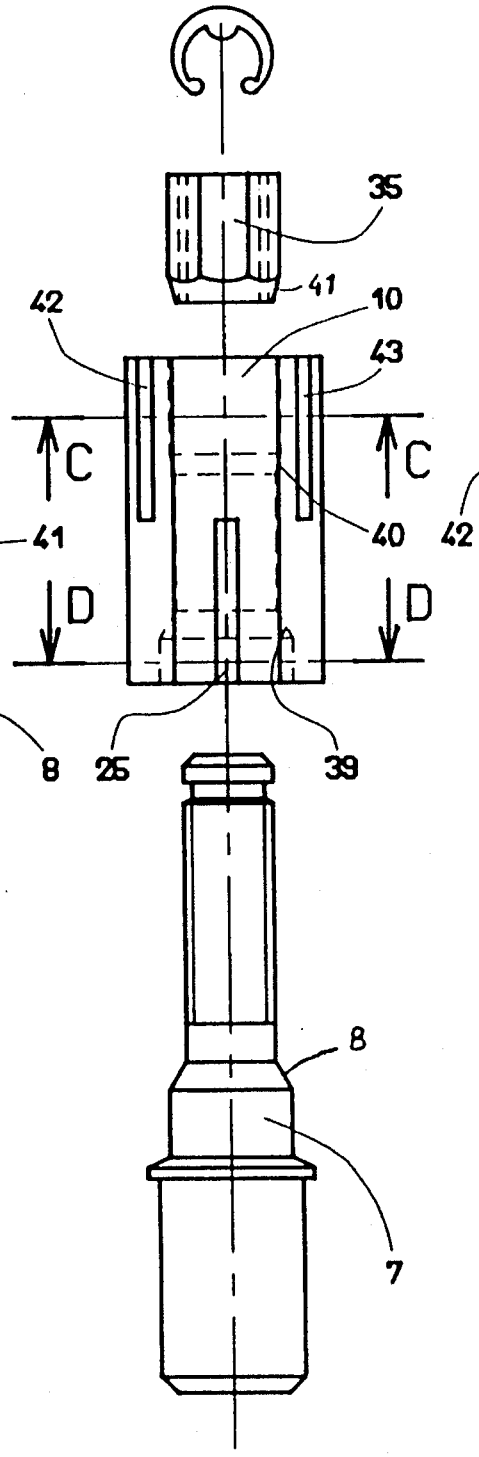
FIG. 7 is an exploded view of the structure from FIG. 6.

In an embodiment shown in FIGS. 1 and 2 the end piece 7 is initially separate and is a force-fit into the inside end 4 of the second tubular section 2.

A sealing collar 26 is fitted over the overlapping end 27 of the first tubular section 1 to which it is fixed in the axial direction. To achieve this axial fixing the sealing collar 26 comprises an interior lip 28 which engages in an exterior annular groove 29 on the first tubular section 1. The end surface 30 of the sealing collar 26 includes an opening 31 whose cross-section matches the exterior cross-section of the second tubular section 2 so that it can slide with a small clearance on the exterior surface of the second tubular section 2.

An abutment limits movement of the locking collar 10 towards the deployed position of the stick. For example the abutment is formed by a nick 32 or by punching the surface of the first tubular section 1 to produce a peg projecting from the inside surface of the first tubular section 1 and against which the end area 12 of the locking collar 10 bears.

Another embodiment of the abutment is shown in FIGS. 1 and 2 and comprises one or more tongues 33 fastened to the sealing collar 26 and housed in the space formed by the exterior groove 22 of the second tubular section 2. The tongue 33 comes into contact with the end area 12 of the locking collar 10 at the end of its travel.

A similar locking arrangement is provided between the second tubular section 2 and the third tubular section 3, as shown in FIG. 2.

The device operates as follows: in the position shown in FIG. 1 the locking collar 10 is spaced from the conical bearing surface 8. In this position the locking collar 10 slides freely with no significant friction inside the first tubular section 1. Accordingly the second tubular section 2 which is fastened axially to the locking collar 10 and the end piece 7 slides freely in the first tubular section 1. To lock the successive sections together when the stick has been set to the required length by relative axial sliding, the user rotates the second tubular section 2 in the first tubular section 1. As the second tubular section 2 rotates the locking collar 10 is locked against rotation relative to the first tubular section 1 and is therefore screwed onto the screwthreaded part 9 when the relative rotation is in the screwing direction. When screwed fully home the locking collar 10 bears on the conical bearing surface 8 which spreads the end area 12. The end area 12 bears against the interior surface 5 of the first tubular section 1 to generate considerable friction preventing any subsequent axial sliding of the tubular sections one within the other. A similar locking action is achieved by relative rotation of the third tubular section 3 in the second tubular section 2.

Unlocking is readily achieved by rotating consecutive tubular members relative to each other in the opposite direction to unscrew the locking collars 10 from the screwthreaded parts 9 of the end pieces 7.

When the locking collar 10 is fully unscrewed, if the user continues to rotate the tubular sections relative to each other the locking collar 10 bears against the wider part 24 of the end piece 7, preventing any further axial rotation and preventing the locking collar 10 separating from the second tubular section 2.

Sliding of the successive sections one within the other in the direction which separates the sections from each other is limited by abutments such as the nick 32 or the tongue 33 bearing against the end area 12 of the locking collar 10.

Figure 8:
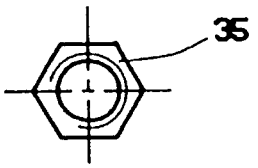
FIG. 8 is an end view of the clamping nut from FIG. 7.
Figure 9:
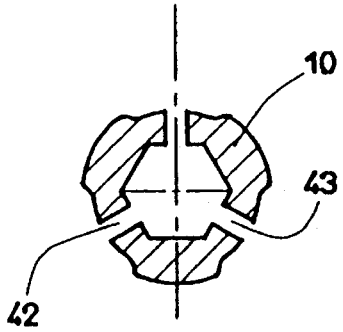
FIG. 9 is a view in transverse cross-section on the line C—C in FIG. 7.
Figure 10:
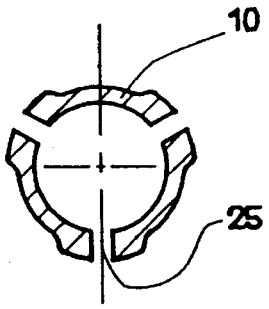
FIG. 10 is a view in transverse cross-section on the line D—D in FIG. 7.

In the embodiment shown in FIGS. 6 through 10 the expandable member is a locking collar 10. The actuator device comprises a first actuator member in the form of a nut 35 screwed onto the screwthreaded part 9 of the axial end piece 7 forming the second actuator member. The nut 35 is shaped to slide axially in an axial passage 36 of the collar 10 and is prevented from rotating relative to said collar 10. To this end the nut 35 advantageously has a prism-shaped exterior surface, a hexagonal shape, for example, the axial passage 36 having a complementary hexagonal shape, as shown in FIG. 8. The collar 10 has on its exterior surface longitudinal locking grooves receiving the respective interior ribs of the first tubular section 1, as in the embodiment of FIGS. 1 and 2. Accordingly, the nut 35 is indirectly locked against rotation in the first tubular section 1 by the collar 10 and bears against an end surface of the collar 10, to be precise the end of the axial passage 36.

In this embodiment the collar 10 has a central part 37 with a substantially cylindrical axial hole and two end parts 38 and 139 with a larger diameter axial hole linked to the hole in the central part 37 by a first generally conical bearing surface 39 and a second generally conical bearing surface 40. The first generally conical bearing surface 39 bears against the respective conical bearing surface 8 of the axial end piece 7. The second generally conical bearing surface 40 of the collar 10 bears against a respective conical bearing surface 41 of the nut 35.

As in the FIG. 1 embodiment the first conical bearing surface 39 of the collar 10 is associated with a first series of slots 25. In this second embodiment the second conical bearing surface 40 of the collar 10 is associated with a second series of longitudinal slots 42, 43 which also allow radial expansion of the collar 10.

Referring to FIGS. 7 through 10, the slots 25 of the first series are interleaved with the slots 42 and 43 of the second series. The conical bearing surfaces 39 and 40 of the collar 10 are substantially one-third and two-thirds along the length of the collar. This significantly increases the surface area of rubbing contact between the collar and the inside surface of the first tubular section 1.

It will be understood that the locking arrangement in accordance with the present invention can be implemented in various ways. FIGS. 13 through 18 show six embodiments in diagrammatic longitudinal cross-section with only the components relative to locking shown.

Figure 13:
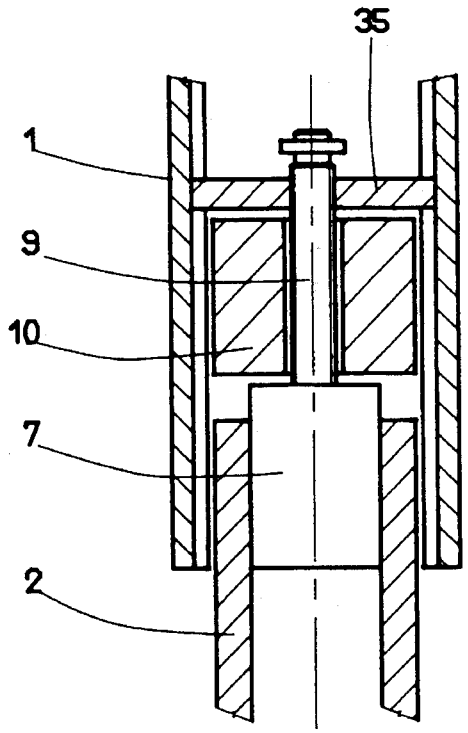
FIGS. 13 through 18 show diagrammatically six other embodiments of the actuator member and the expandable member.

In FIG. 13 the expandable member is a generally cylindrical locking collar 10 having an axial bore. The collar 10 is made from an elastomer material and slides with a small clearance in the first tubular section 1. The actuator device comprises a first actuator member in the form of a nut 35 and a second actuator member in the form of the end piece 7 fixed into the second tubular section 2. The nut 35 incorporates locking grooves (not shown in the figure) which receive the locking ribs 13, 14 on the first tubular section 1. The nut 35 bears against an end surface of the collar 10. The elastomer collar 10 is pressed axially against the nut 35 and the base of the axial end piece 7 when the nut 35 is screwed onto the screwthreaded part of the axial end piece 7 to cause radial expansion of the collar 10 and locking of the tubular members 1 and 2 relative to each other.

Figure 14:
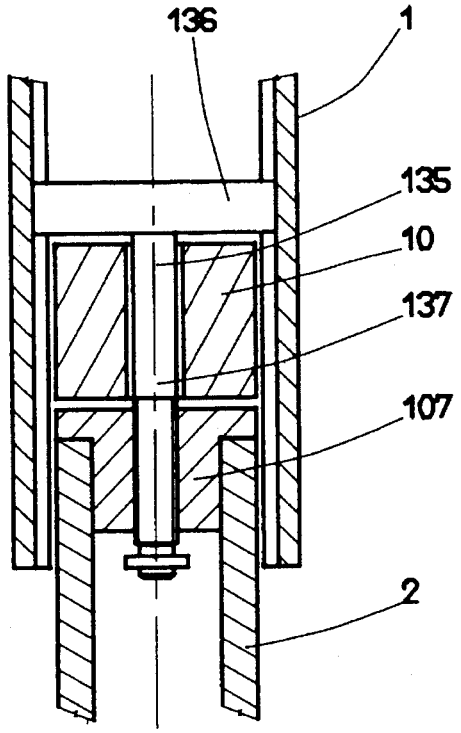

In the FIG. 14 embodiment the expandable locking member formed by the collar 10 is similar to that in FIG. 13 and is pressed axially by the actuator member, also in a similar manner. In this embodiment the actuator device comprises a first actuator member in the form of a screw 135 whose head 136 has on its outside surface the locking grooves receiving the locking ribs 6, 13, 14 on the first tubular member 1. The shank 137 screws into a screwthreaded bore of the second actuator member 107.

In the FIG. 13 and 14 embodiments the collar 10 may have a smooth outside surface with no longitudinal grooves.

Figure 15:
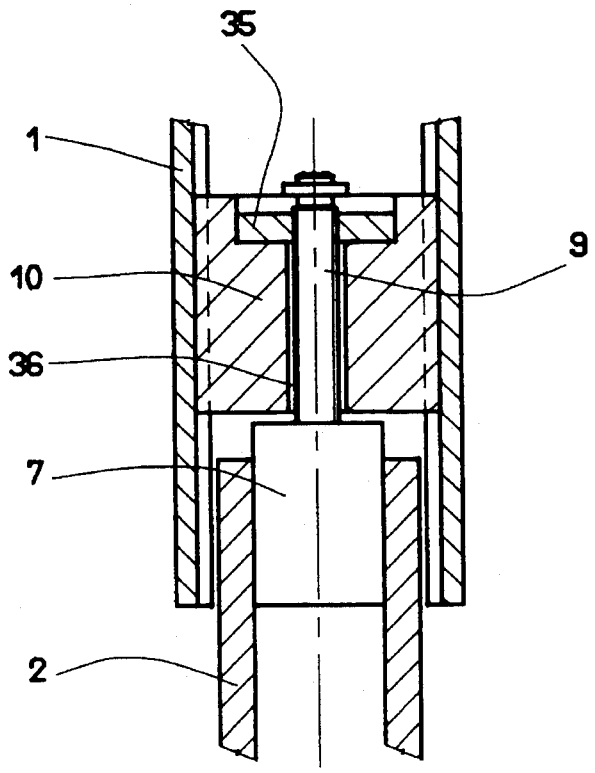
Figure 16:
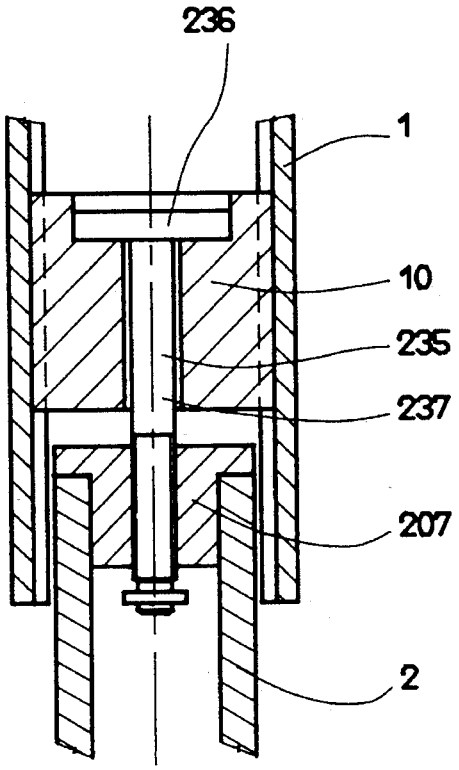

In the FIG. 15 and 16 embodiments, on the other hand, the expandable locking member is a locking collar with a smooth internal bore and its outside surface comprises the peripheral longitudinal locking grooves which receive the interior locking ribs 6, 13, 14 of the first tubular member 1. In FIG. 15 the actuator device is of similar design to that of the FIG. 6 embodiment, with a first actuator member 35 in the form of a hexagonal nut sliding axially in a complementary axial passage 36 of the collar 10 and with an end piece 7 forming the second actuator member. The nut 35 is screwed onto a screwthreaded part 9 of the end piece. The nut 35 is constrained to rotate with the collar 10 which itself is constrained to rotate with the first tubular member 1.

In FIG. 16 the actuator device comprises a screw 235 whose hexagonal head 236 is housed in a complementary housing in the collar 10 and whose shank 237 is screwed into a screwthreaded bore in the end piece 207 forming the second actuator member.

Figure 17:
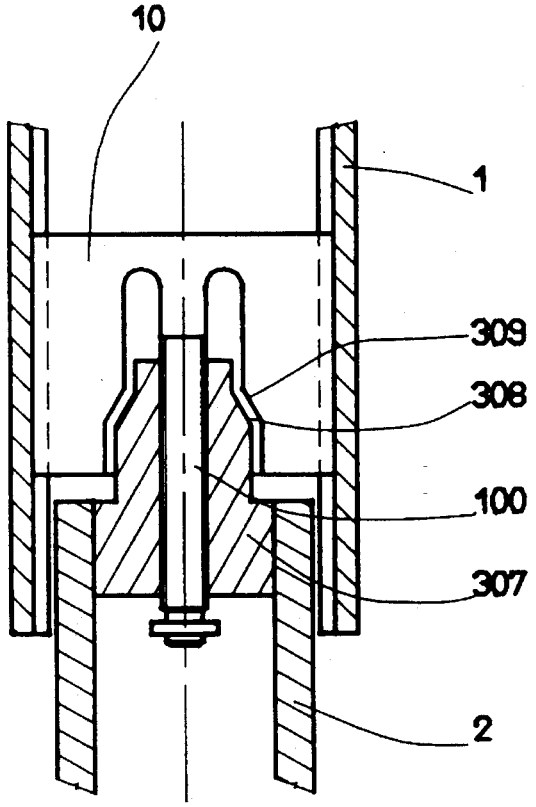

FIG. 17 shows an embodiment in which the collar 10 itself forms the first actuator member and comprises a head with locking grooves and a screwthreaded shank 100 screwed into a complementary screwthreaded bore of an end piece 307 forming the second actuator member. The end piece 307 comprises a generally conical bearing surface 308 cooperating with a generally conical interior bearing surface 309 of the collar 10 to expand the latter.

Figure 18:
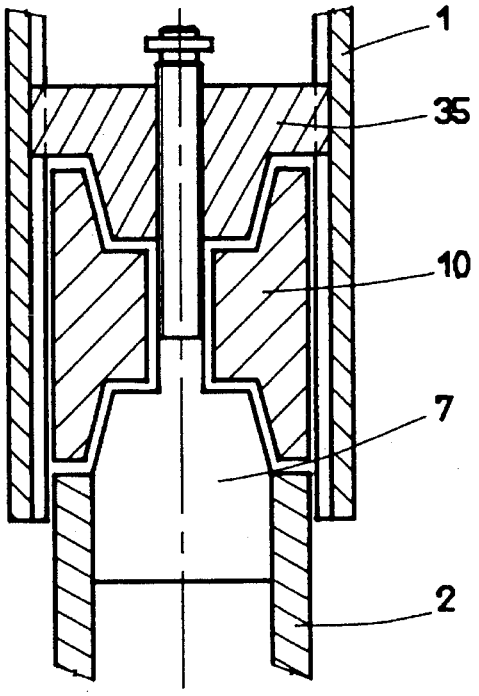

FIG. 18 shows an embodiment similar to that of FIG. 13 in which the collar 10 comprises near both axial ends conical interior bearing surfaces to cooperate with complementary generally conical exterior bearing surfaces on the nut 35 and the end piece 7.

These embodiments are described by way of example only and other combinations of the designs of the first actuator member, the second actuator member and the expandable locking member may be used and adapted in ways that will be evident to the man skilled in the art.

The locking effect may be rendered even more secure by using an elastomer locking collar and an actuator device which simultaneously applies axial compression to the two end faces of said collar and a radially outward force to the inside surface of its axial bore via respective generally conical bearing surfaces. The radial deformation of the collar can be improved in this way and rendered more regular, the collar being applied very effectively to the inside surface of the first tubular member. This may be achieved in the FIG. 18 embodiment, for example.

Figure 11:
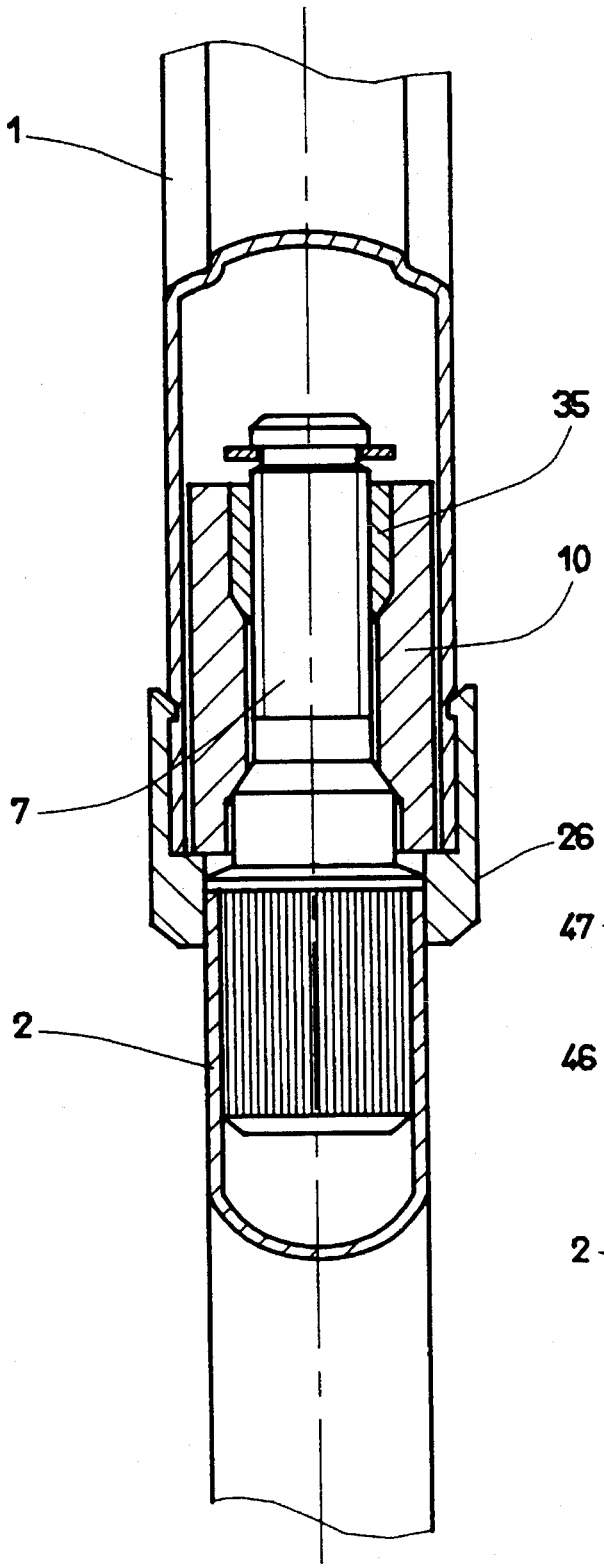
FIG. 11 is a view in partial cross-section showing a first embodiment of sealing collar.

In the FIG. 11 embodiment a sealing collar 26 is fitted around the end of the larger diameter first tubular section 1. The collar 26 may turn axially relative to the first tubular section 1, as in the FIG. 1 and 2 embodiment.

Figure 12:
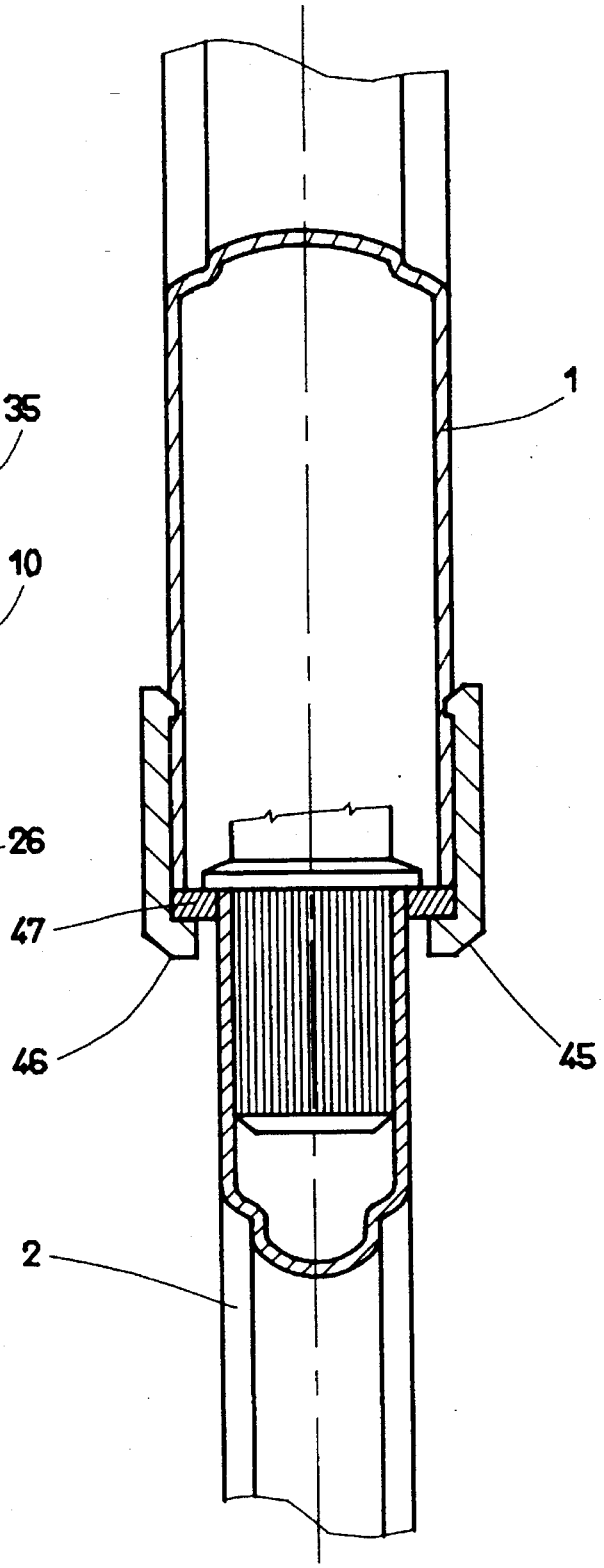
FIG. 12 is a view in partial cross-section showing a second embodiment of sealing collar.

In the FIG. 12 embodiment the seal is provided by a sealing collar 45 fitted over the end of the larger diameter first tubular section 1 and prevented from rotating or moving in translation relative to the latter. The collar 45 has a rim 46 fitting over a splined annular spacer 47 inserted between the lip 46 of said collar 45 and the edge of the larger diameter first section 1. The spacer 47 can slide on the smaller diameter second section 2 relative to which it is prevented from rotating by engagement of its internal splines with the external splines of the second tubular section 2, so achieving a good seal.

The present invention is not limited to the embodiments specifically described but encompasses all variants and generalizations thereof within the scope of the following claims.

I claim:

1. Telescopic tubular assembly comprising:

at least one larger diameter first tubular section (1) and one smaller diameter second tubular section (2) having an inside end (4) housed inside the first tubular section (1) and able to rotate freely and to slide inside the first tubular section (1) between a retracted position and a deployed position, an actuator device comprising a first actuator member sliding in the larger diameter first tubular section (1) and comprising a second actuator member fixed to the smaller diameter second tubular section (2), the first actuator member and the second actuator member cooperating with each other in the manner of a screw in order to displace the first actuator member axially upon relative axial rotation, an expandable locking member sliding axially in the larger diameter first tubular section (1), constrained to move in axial translation with the smaller diameter second tubular section (2) and being capable of expanding or retracting radially when the first actuator member moves axially, the interior surface (5) of the larger diameter first tubular section (1) comprising at least three equi-angularly distributed longitudinal ribs (6, 13, 14) extending along all or the major part of its length and each engaged in a respective longitudinal peripheral locking groove (15, 16, 17) of the expandable locking member to lock it against rotation, the interior ribs of the first tubular section (1) being formed by depressing the wall of said tubular section to form simultaneously longitudinal exterior grooves (18, 19, 20) which are narrower than the interior ribs (6, 13, 14), characterized in that:

the second tubular section (2) comprises similar interior ribs and exterior grooves, its exterior grooves (21, 22, 23) being narrower than the interior ribs (6, 13, 14) of the first tubular section (1) to prevent their mutual interengagement, the ribs (6, 13, 14) of the first tubular section (1) are shaped to bear with a small clearance and simultaneously against the exterior surface of the smaller diameter second tubular section (2), said ribs (6, 13, 14) of the first tubular section have a wide and rounded concave outermost surface to mate with a significant portion of the exterior surface of the second tubular section (2) and to constitute between the tubular sections (1, 2) a bearing surface adapted to withstand mechanical bending loads exerted on the telescopic tubular assembly.

2. Telescopic tubular assembly according to claim 1 characterized in that the first and second tubular sections define a first junction, and wherein the telescopic tubular assembly comprises three successive tubular sections (1, 2, 3) joined together such that the second and third tubular sections define a second junction which is substantially similar to the first junction, the tubular sections being capable of being locked or unlocked by axial rotation, the first two tubular sections (1, 2) at least comprising longitudinal ribs and grooves to prevent relative rotation.

3. Telescopic tubular assembly according to claim 1 characterized in that the first actuator member comprises the expandable member itself which is a collar having a screwthreaded axial bore screwed onto a protruding axial screwthreaded part (9) of the second actuator member the expandable member having said locking grooves (15, 16, 17) on its exterior surface.

4. Telescopic tubular assembly according to claim 1 characterized in that the first actuator member comprises the expandable member itself which is a screw whose head comprises said locking grooves (15, 16, 17) and whose screwthreaded shank (100) is screwed into a screwthreaded bore of the second actuator member.

5. Telescopic tubular assembly according to claim 1 characterized in that the first actuator member is a nut (35) separate from the expandable member, screwed onto a protruding axial screw-threaded part (9) of the second actuator member and comprising on an exterior surface of the expandable member said locking grooves (15, 16, 17), the nut (35) bearing against an end surface of the expandable member (10).

6. Telescopic tubular assembly according to claim 1 characterized in that the first actuator member is a screw (135) whose head (136) has locking grooves on its exterior surface and whose screwthreaded shank (137) is screwed into a screwthreaded bore of the second actuator member.

7. Telescopic tubular assembly according to claim 1 characterized in that the first actuator member is a nut (35) screwed onto a protruding axial screwthreaded part (9) of the second actuator member, an external surface of the nut (35) sliding axially in an axial passage (36) of the expandable member and being locked against rotation relative to said expandable member which comprises on an exterior surface of the expandable member said locking grooves (15, 16, 17), the nut (35) bearing against an end surface of the expandable member.

8. Telescopic tubular assembly according to claim 7 characterized in that:

the expandable member is a collar having a central part (37) with a substantially cylindrical axial hole and two end parts (38, 139) with a larger diameter axial hole joined to the hole in the central part (37) by generally conical first and second bearing surfaces (39, 40), the first conical bearing surface (39) bears on a complementary conical bearing surface (8) of the second actuator member, the second conical bearing surface (40) bears on a complementary conical bearing surface (41) of the first actuator member (35), the conical bearing surfaces (39, 40) are associated with two series of longitudinal slots (25, 42, 43) allowing radial expansion of the collar.

9. Telescopic tubular assembly according to claim 8 characterized in that:

the slots (25) of a first series of slots are interleaved with the slots (42, 43) of the second series of slots of the collar (10), the conical bearing surfaces (39, 40) of the collar (10) are substantially one-third and two-thirds along the length of the collar.

10. Telescopic tubular assembly according to claim 1 characterized in that a generally conical interior surface (39) of the expandable member bears against a generally conical exterior surface (8) of the second actuator member to cause expansion of the respective end area of the expandable member.

11. Telescopic tubular assembly according to claim 1 characterized in that a sealing collar (26) is fitted over an overlapping end (27) of the first tubular section (1) to which it is fastened axially, the sealing collar (26) having an end part (30) shaped to slide with a small clearance on the outside surface of the second tubular section (2).

12. Telescopic tubular assembly according to claim 1 characterized in that the junction between two successive sections (1, 2) is sealed by a sealing collar (45) fitted around the end of the larger diameter first tubular section (1), prevented from moving relative to the latter in-rotation and in translation and comprising a lip (46) fitting over a splined annular spacer (47) inserted between the lip (46) of said collar (45) and an edge of the larger diameter first section (1), the spacer (47) being able to slide on the smaller diameter second section (2) and being locked against rotation relative to said second section.

13. Telescopic tubular assembly according to claim 1 characterized in that an abutment (32, 33) limits displacement of the expandable member towards the deployed position.

* * * * *